US009211635B2

(12) United States Patent
Poole

(10) Patent No.: US 9,211,635 B2
(45) Date of Patent: Dec. 15, 2015

(54) SELF-ADJUSTING BAR CLAMP

(71) Applicant: Robert N. Poole, Scottsdale, AZ (US)

(72) Inventor: Robert N. Poole, Scottsdale, AZ (US)

( * ) Notice: Subject to any disclaimer, the term of this patent is extended or adjusted under 35 U.S.C. 154(b) by 0 days.

(21) Appl. No.: 14/449,945

(22) Filed: Aug. 1, 2014

(65) Prior Publication Data

US 2015/0033514 A1 Feb. 5, 2015

Related U.S. Application Data

(60) Provisional application No. 61/861,317, filed on Aug. 1, 2013.

(51) Int. Cl.

| | |
|---|---|
| ***B25B 5/16*** | (2006.01) |
| ***B25B 5/08*** | (2006.01) |
| ***B25B 5/06*** | (2006.01) |

(52) U.S. Cl.

CPC ..... *B25B 5/166* (2013.01); *B25B 5/068* (2013.01); *B25B 5/085* (2013.01)

(58) Field of Classification Search

CPC ..... B25B 5/068; B25B 5/02; B25B 5/085; B25B 5/12

USPC ..... 269/3, 4, 6, 71, 228

See application file for complete search history.

(56) References Cited

U.S. PATENT DOCUMENTS

| | | | | |
|---|---|---|---|---|
| 5,772,193 | A * | 6/1998 | Dykstra | 269/228 |
| 5,791,835 | A * | 8/1998 | Chiang et al. | 408/115 R |
| 5,853,168 | A * | 12/1998 | Drake | 269/6 |
| 6,367,787 | B1 * | 4/2002 | Poole et al. | 269/6 |
| 6,382,608 | B1 * | 5/2002 | Michell | 269/6 |
| 6,568,667 | B1 * | 5/2003 | Hall | 269/6 |
| 6,585,243 | B1 * | 7/2003 | Li | 269/6 |
| 6,591,719 | B1 * | 7/2003 | Poole et al. | 81/370 |
| 6,648,315 | B1 * | 11/2003 | Lee | 269/6 |
| 6,655,670 | B1 * | 12/2003 | Liou | 269/6 |
| 6,676,120 | B1 * | 1/2004 | Hallbeck et al. | 269/6 |
| 6,776,072 | B2 * | 8/2004 | Poole et al. | 81/370 |
| 6,957,808 | B2 * | 10/2005 | Varzino et al. | 269/95 |
| 7,017,894 | B1 * | 3/2006 | Lin | 269/6 |
| 7,090,209 | B1 * | 8/2006 | Rowlay | 269/6 |
| 7,172,183 | B1 * | 2/2007 | Yang | 269/6 |
| 7,325,797 | B2 * | 2/2008 | Kloepfer et al. | 269/6 |
| 7,389,978 | B2 * | 6/2008 | Rowlay et al. | 269/6 |
| 7,437,978 | B1 * | 10/2008 | Aldredge | 81/367 |
| 7,513,492 | B1 * | 4/2009 | Kuo | 269/6 |
| 7,604,224 | B2 * | 10/2009 | Rowlay et al. | 269/6 |
| 7,614,617 | B2 * | 11/2009 | Marusiak | 269/6 |
| 7,624,974 | B2 * | 12/2009 | Zheng | 269/6 |
| 7,641,183 | B2 * | 1/2010 | Fuller et al. | 269/6 |
| 7,651,078 | B2 * | 1/2010 | Geier et al. | 269/6 |

(Continued)

*Primary Examiner* — Lee D Wilson
*Assistant Examiner* — Jamal Daniel
(74) *Attorney, Agent, or Firm* — Robert A. Parsons; Michael W. Goltry; Parsons & Goltry

(57) ABSTRACT

A self-adjusting bar clamp includes a body defining an elongated channel and an actuating lever pivotally coupled to the body and movable between an open position and a closed position. An elongated bar is carried by the body for reciprocal sliding movement therethrough. A self-adjusting toggle mechanism carried by the body includes a locking element carried by the bar and an element pivotally coupled to the actuating lever. A cam element is pivotally coupled between the element and the locking element. The cam element is movable between a first condition permitting movement and a second condition. A biasing member biases the locking element in a first direction.

19 Claims, 8 Drawing Sheets

(56) References Cited

U.S. PATENT DOCUMENTS

| | | | | |
|---|---|---|---|---|
| 7,699,297 | B2 * | 4/2010 | Cicenas et al. | 269/6 |
| 7,735,813 | B2 * | 6/2010 | Geier et al. | 269/6 |
| 7,815,175 | B2 * | 10/2010 | Cicenas et al. | 269/6 |
| 7,896,322 | B2 * | 3/2011 | Geler et al. | 269/6 |
| 7,942,392 | B2 * | 5/2011 | Geier et al. | 269/6 |
| 8,016,276 | B2 * | 9/2011 | Geier et al. | 269/6 |
| 8,074,340 | B2 * | 12/2011 | Cicenas et al. | 29/559 |
| 8,240,647 | B2 * | 8/2012 | Geier et al. | 269/254 CS |
| 8,430,383 | B2 * | 4/2013 | Strauss | 269/5 |
| 8,590,871 | B2 * | 11/2013 | Geier et al. | 269/6 |
| 8,613,433 | B2 * | 12/2013 | Poole et al. | 269/228 |
| 8,702,076 | B2 * | 4/2014 | Cicenas et al. | 269/6 |
| 8,850,672 | B2 * | 10/2014 | Yang | 24/524 |
| 8,882,093 | B2 * | 11/2014 | Kuo | 269/6 |
| 2006/0049563 | A1 * | 3/2006 | Kloepfer et al. | 269/6 |
| 2006/0091596 | A1 * | 5/2006 | Marusiak | 269/6 |
| 2006/0125166 | A1 * | 6/2006 | Gerritsen et al. | 269/6 |
| 2008/0246203 | A1 * | 10/2008 | Alexander | 269/6 |
| 2009/0179363 | A1 * | 7/2009 | Liou | 269/6 |
| 2012/0187617 | A1 * | 7/2012 | Kuo | 269/6 |
| 2012/0193853 | A1 * | 8/2012 | Patel et al. | 269/6 |
| 2013/0264758 | A1 * | 10/2013 | Kuo | 269/6 |
| 2014/0182116 | A1 * | 7/2014 | Cicenas et al. | 29/559 |
| 2014/0265084 | A1 * | 9/2014 | Evatt et al. | 269/6 |

* cited by examiner

SELF-ADJUSTING BAR CLAMP

CROSS-REFERENCE TO RELATED APPLICATION

This application claims the benefit of U.S. Provisional Patent Application No. 61/861,317, filed 1 Aug. 2013.

FIELD OF THE INVENTION

This invention relates to clamps for holding objects and more specifically to bar clamps.

BACKGROUND OF THE INVENTION

In the filed of clamps, bar clamps are a well known tool having many and varied applications. The concept of a bar clamp is old and well-known. In recent years, bar clamps have been developed which can be operated by one hand, and are held by a friction member. A trigger handle advances a slide bar by driving a lever which binds against a surface of the slide bar and moves the bar as the lever is moved. The lever is returned by spring force to its original position after each stroke of the trigger handle, the lever sliding over the bar surface during its return motion, (i.e. U.S. Pat. No. 4,926,722 by Sorensen et al. and U.S. Pat. No. 5,022,137 by Sorensen et al.). While very successful, these devices have a distinct limitation in clamping force. Specifically, the force exerted between clamping jaws is determined by the pressure applied to the lever by a user's grip. Thus, while a person with a strong grip can apply more pressure than a person with a weak grip, the pressure applied is still limited to human strength. Additionally, the force applied is difficult to control, relying on an individual user's judgment of how much pressure is being applied.

It would be highly advantageous, therefore, to remedy the foregoing and other deficiencies inherent in the prior art.

An object of the present invention is to provide a bar clamp wherein the clamping pressure can be adjusted.

Another object of the present invention is to provide a bar clamp that can provide great clamping pressure through mechanical advantage.

SUMMARY OF THE INVENTION

Briefly, to achieve the desired objects and advantages of the instant invention, provided is a self-adjusting bar clamp. The self-adjusting bar clamp includes a body having a rear end defining a rear aperture and a front end defining a front aperture. The body defines an elongated channel extending between the rear end and the front end. An actuating lever having a first end pivotally coupled to the body at a pivot point, is movable between an open position and a closed position and has a second end. An elongated bar is positioned in the elongated channel of the body, and has a rearward end extending rearwardly from the rear aperture and a forward end extending forwardly from the front aperture and is carried by the body for reciprocal sliding movement therethrough. The forward end terminates in a pressure foot. A self-adjusting toggle mechanism is provided which includes a locking element carried by the elongated bar within the elongated channel for reciprocal and canting movement. An element pivotally coupled to the actuating lever intermediate the first end and the second end and a cam element pivotally coupled to the element and pivotally coupled to the locking element. The cam element is movable between a first condition permitting the locking element to reciprocate along the elongated bar and a second condition bearing against the elongated bar and canting the locking element into frictional engagement with the elongated bar. A biasing member is captured between one of the rear end and the front end of the body, and the locking element, biasing the locking element in a first direction.

The locking member in the opened position of the actuating lever being positioned for sliding movement in relation to the elongated bar, the locking member in the closed position of the actuating lever, moves the elongated bar incrementally through the body in a second direction opposite the first direction; and The self-adjusting bar clamp can also include a secondary locking element carried by the elongated bar proximate the forward end of the body and movable between an engaged position and a released position. The secondary locking element is biased by a biasing member into frictional engagement with the elongated bar in the engaged position, preventing movement of the elongated bar in the first direction, and selectively movable to disengage the elongated bar in the release position against the bias of the biasing member, permitting movement of the elongated bar in the first direction. The secondary locking element can be moved from the engaged position to the release position by rearward movement of the bottom of the secondary locking element, or if a lobe extending forwardly from the first end of the actuating lever is provided, by moving the lever in the open position. In the open position, the lobe engages the secondary locking element moving the secondary locking element to the release position.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE DRAWINGS

Figure 1:
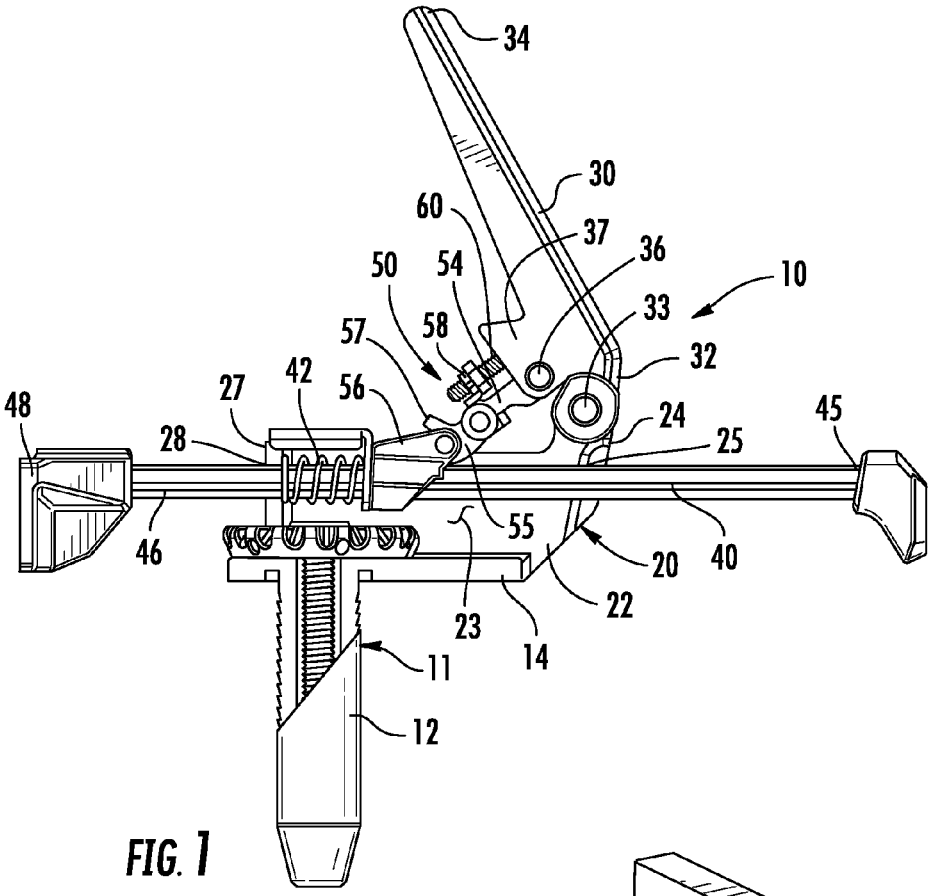
FIG. 1 is a sectional side view of a self-adjusting bar clamp in accordance with the present invention.

Turning now to the drawings in which like reference characters indicate corresponding elements throughout the several views, attention is first directed to FIG. 1 which illustrate a self-adjusting bar clamp generally designated 10, in accordance with the present invention. Clamp 10 includes mounting apparatus 11, which in this embodiment includes a locking peg 12 extending from a base 14. Locking peg 12 is designed to be fixedly (but removably) received in a peg hole 15 formed in a supporting surface 16 (FIGS. 3 and 4) such as a work bench and the like. Locking peg 12 includes a two piece offset shaft which can be inserted into an aperture 15 when aligned, and fixedly wedged in position when misaligned. Also, the body described in detail below may be considered a part of mounting apparatus 11 for purposes of this disclosure.

A body 20 is formed of a pair of upright sides 22 extending in parallel spaced apart relationship to essentially form an elongated channel 23. Sides 22 are joined at a rear end 24 either by forming sides 22 integrally from a single elongated strip of metal or with interlocking ends or end wall, and define a rear aperture 25. Sides 22 are joined at a front end 27 either by forming sides 22 integrally from a single elongated strip of metal or with interlocking ends or end wall, and define a front aperture 28. Also, sides 22 can be formed integrally with base 14 so that the bottom edge of each side 22 flares outwardly at a ninety degree angle to form base 14 in two spaced apart portions or base 14 can be a single piece with the bottom edges of sides 22 fixedly attached thereto, as by welding or the like so as to rest against and stabilize clamp 10 on supporting surface 16.

An elongated actuating lever 30 includes a rearward end 32 pivotally coupled to body 20 proximate rear end 24 above elongated channel 23 at a pivot point 33, and extends forwardly to a forward end 34. Actuating lever 30 includes, in this specific embodiment, a pivot point 36 extending between two parallel projections 37 extending downwardly from actuating lever 30 intermediate forward end 34 and rearward end 32. The two parallel projections 37 are spaced apart at pivot point 36 to form a mounting yoke that is positioned on both sides of a link, with a pivot pin extending through both parallel projections 37 and the link, which will be described presently.

Still referring to FIG. 1, an elongated bar 40 with a compression spring 42 axially disposed around a portion thereof, is positioned in elongated channel 23 of body 30. Bar 40 includes a rearward end 45 extending rearwardly from rear aperture 25 and a forward end 46 extending forwardly from front aperture 28 and terminating in a pressure foot 48. Bar 40 is carried by body 20 for reciprocal sliding movement therethrough.

A self-adjusting toggle mechanism 50 generally includes three pivotally linked elements designated element 54, cam element 55, and locking element 56. Element 54 has an elongated body with the rearward end pivotally attached between spaced apart parallel projections 37 of actuating lever 37 at pivot point 36. The forward end of element 54 is bifurcated and the rearward end of cam element 55 is pivotally mounted in the bifurcation. Also, the forward end of element 54 has a vertically upwardly extending boss 58 formed thereon with a horizontally extending (generally parallel to element 54) threaded opening therethrough. An adjustment screw 60 is threadedly engaged in the opening and is oriented so that the forwardly extending end is movable. The front end of cam element 55 is pivotally engaged in a bifurcated rearward end of locking element 56 and the front end of locking element 56 is slideably engaged over bar 40 and butts against a rearward end of compression spring 42. The forward end of spring 42 butts against the inner front end 27 of body 20. Spring 42 is captured between front end 27 and locking element 56. The front end of cam element 55 defines an upwardly and forwardly facing pressure adjustment surface 57 positioned to engage the front end of adjustment screw 60 and adjust downward pivotal movement of self-adjusting toggle mechanism 50, allowing for adjustment of the clamping force provided.

Figure 2:
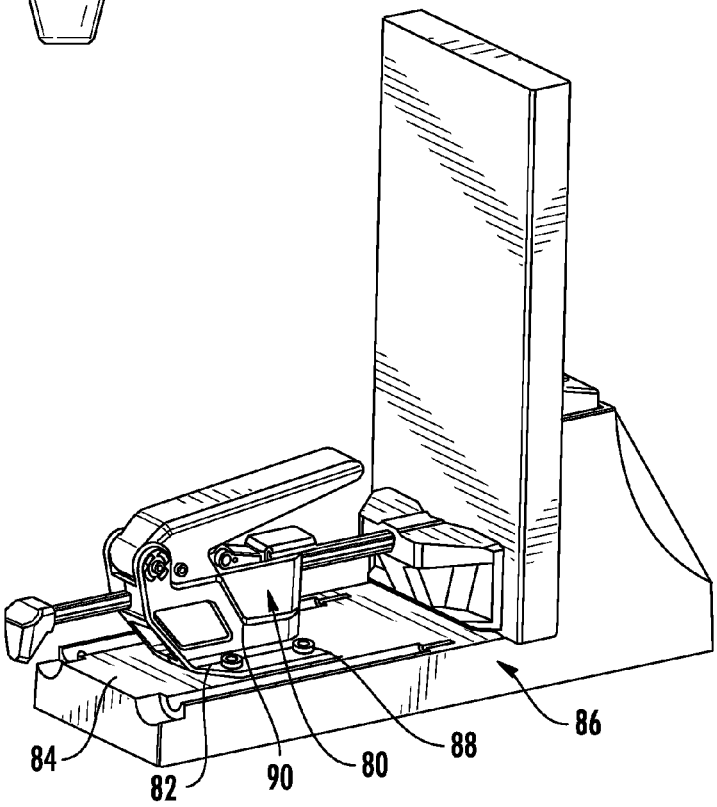
FIG. 2 is a perspective view of a self-adjusting bar clamp with a different mounting member.
Figure 3:
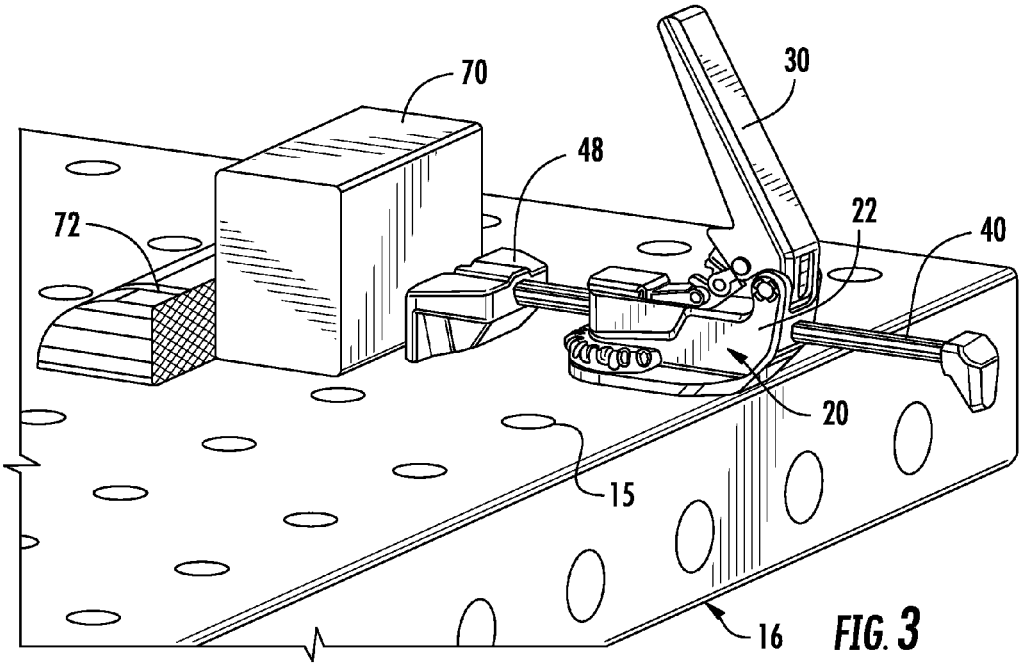
FIG. 3 is a perspective view of the self-adjusting bar clamp of FIG. 1, in the unclamp position.
Figure 4:
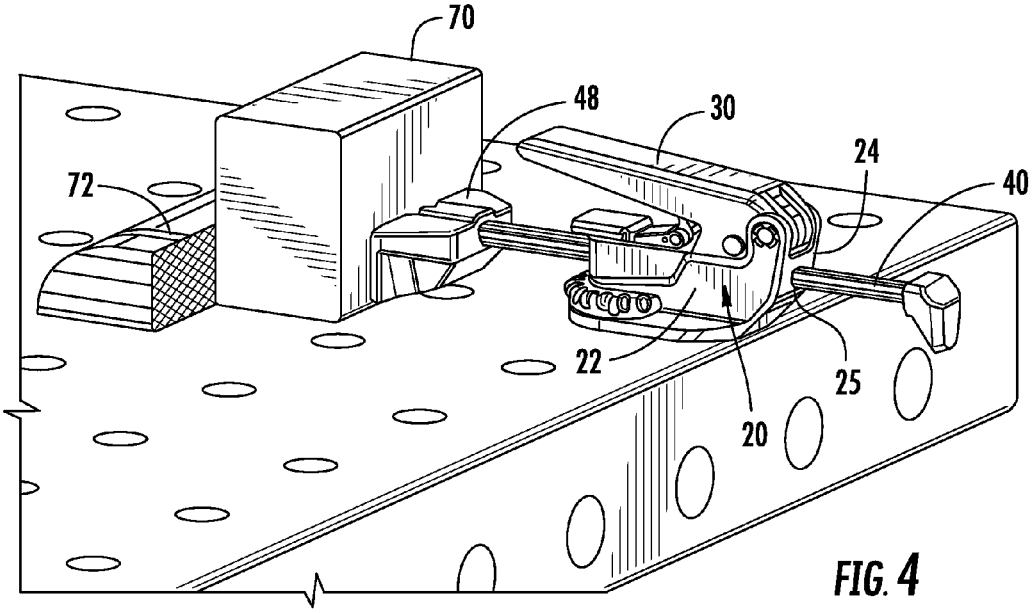
FIG. 4 is a perspective view of the self-adjusting bar clamp of FIG. 1, in the clamp position.

With additional reference to FIGS. 3 and 4, actuating lever 30 is movable between an opened position (FIG. 1) and a closed position (FIGS. 2 and 4) to clamp a work piece 70 against an abutment 72 carried by surface 16. In the opened position of actuating lever 30, pressure foot 48 is spaced from work piece 70 and locking element 56 is positioned for sliding movement in relation to bar 40. In the open position, bar 30 is manually pushed forwardly so that pressure foot 48 engages work piece 70. In response to pivotal movement of actuating lever 30 toward base 14, pressure foot 48 is moved toward abutment 72 until it engages work piece 70 disposed on the working surface and element 54 pivots at pin 46, which causes cam element 55 to pivot toward bar 40 at the union of elements 55 and 56. As element 54 and 55 pivot, locking element 56 moves toward bar 40 and the angular disposition of cam element 55 and element 54 relative to bar 40 progressively lessens. With pressure foot 48 engaged against work piece 70, continued movement of actuating lever 30 toward base 14 drives toggle mechanism 50, causing locking element 56 to slide forwardly and elements 54 and 55 to pivot toward bar 40 until the point at which the bottom surface of cam element 55 bears against bar 40. At the point of contact between cam element 55 and bar 40, cam element 55 pivots ever so slightly away from bar 40 and drives locking element 56 away from bar 40 at the junction of elements 55 and 56, which causes locking element 56 to cant and thus frictionally engage bar 40. Cam element 55 thus acts as a lever, driving locking element 56 so as to cause it to cant and frictionally engage bar 40 in response to the force applied to actuating lever 30 in a direction toward base 14, which force is transferred to cam element 55 by element 54. This frictional engagement frictionally locks locking element 56 to bar 40. In response to continued force applied to actuating lever 30 toward base 14 and with locking element 56 frictionally locked against bar 40, a clamping pressure is applied by pressure foot 48 to work piece 70. In the closed position of actuating lever 30, an over-the-center locking occurs at element 54 in relation to the pivoting action that takes place between actuating lever 30 and element 54 and between element 54 and cam element 55, thus locking actuating lever 30 in the closed position. This process takes place regardless of the size of the work piece positioned between pressure foot 48 and abutment 72 because of the self adjusting feature. To open self-adjusting bar clamp 10 or otherwise release pressure foot 48 from the work piece, actuating lever 30 need only be forcibly moved out of the closed position.

When actuating lever 30 is in the opened position and moved toward base 14, surface 57 of cam element 55 pivots against the rear surface of adjustment screw 60. In this starting position the lower surface of cam element 55 is spaced from bar 40 and disposed angularly relative to bar 40. The distance from and angular disposition of cam element 55 relative to bar 40 when surface 57 of cam element 55 abuts against the rear surface of adjustment screw 60 in the starting position is determinative of the clamping pressure applied by pressure foot 48 against a work piece positioned between pressure foot 48 and abutment 72 when actuating lever 30 is in its closed position. The closer cam element 55 is to bar 40 and the lesser the angular disposition of cam element 55 relative to bar 40 in the starting position the farther forward is the engagement of cam element 55 to bar 40 and the coincident frictional engagement between locking element 56 and bar 40. The farther cam element 55 is away from bar 40 and the greater the angular disposition of cam element 55 is relative to bar 40 in the starting position the farther rearward is the engagement of cam element 55 to bar 40 and the coincident frictional engagement between locking element 56 and bar 40. Because the over-the-center clamping action provided between element 54 and actuating lever 30 and the coincident pressure applied by pressure foot 48 to a work piece decreases the further forwardly the frictional engagement occurs between locking element 56 and rod 40 and increases the further rearwardly the frictional engagement occurs between locking element 56 and bar 40, adjustment of the clamping pressure is controlled by adjustment of screw 60. In this regard, adjusting the rearward end of adjusting screw 60 toward surface 57 of cam element 55 increases the distance of cam element 55 from bar 40 and increases the angular disposition of cam element 55 relative to bar 40, which results in an increased clamping pressure applied by pressure foot 48 to a work piece. Adjusting the forward end of adjusting screw 60 away from surface 57 of cam element 55 decreases the distance of cam element 55 from bar 40 and decreases the angular disposition of cam element 55 to bar 48, which results in a decreased clamping pressure applied by pressure foot 48 to a work piece. It should be understood that once adjusting screw 60 is set for a predetermined pressure, that pressure is applied without the need to further adjust the position of pressure foot 48, as its position will be self-adjusted by the mechanism. It will also be understood that the various bifurcated elements and pivotal pins associated therewith could be reversed if desired or non-bifurcated ends pivotally attached could be used.

Compression spring 42 encircles or axially surrounds bar 40 and is captured between the front end of locking element 56 and front end 27 of body 20. Spring 42 provides a rearward bias, urging locking element 56 rearwardly. The action applied by spring 42 to locking element 56 enables a user to easily open actuating lever 30 and thus release pressure on pressure foot 48. In addition to or in lieu of spring 42, a combination of compression and tension springs can be employed to perform the biasing action if desired.

In operation, base 14 is affixed to a work table or the like by locking peg 12 extending into holes 15. A work piece 70 to be captured is placed on the supporting surface 16 adjacent base 14 and generally in front of pressure foot 48. Bar 40 is moved forwardly though body 20 until pressure foot 48 engages work piece 70. Actuating lever 30 is pressed downwardly to the closed position so that pressure foot 48 is cammed forwardly to engage work piece 70. Actuating lever 30 is then pressed further downwardly until elements 54, 55, and 56 of toggle mechanism 50 react as described above and lock in position. In the reverse operation, actuating lever 30 is lifted to retract pressure foot 48 and release any work piece that might be captured thereby.

Turning now to FIG. 2, an embodiment of a self-adjusting bar clamp 80, substantially identical to bar clamp 10 is illustrated. Bar clamp 80 differs from bar clamp 10 in that locking peg 12 is absent, and this mounting mechanism is replaced with base 14 having a plurality of apertures. Bar clamp 80 includes a base 82 defining a flat plane and designed to be fixedly (but removably) attached to a supporting surface 84 of a jig 86, a work bench, work table, etc. Base 82 has mounting holes 88 formed therein on each side of a body 90 for fixedly (but removably) attaching clamp 80 to supporting surface 84.

Figure 5:
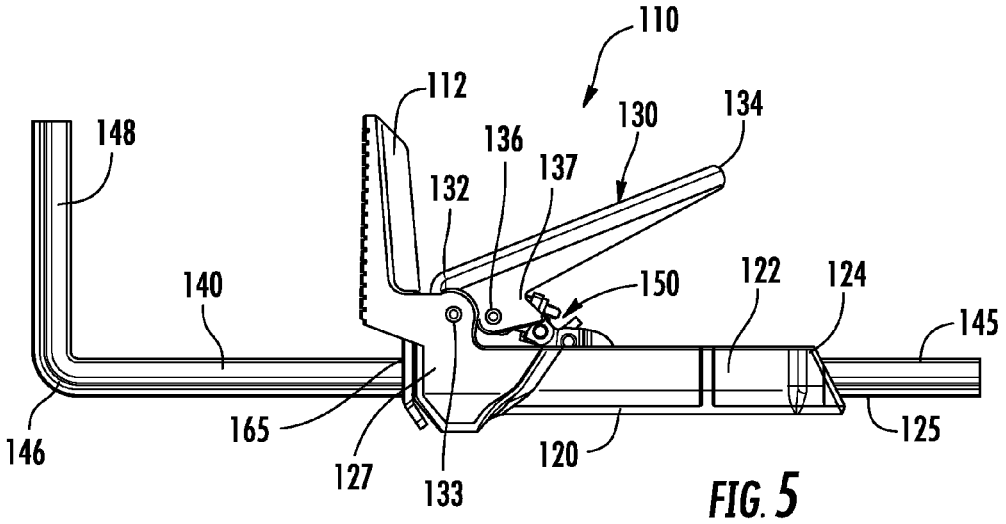
FIG. 5 is a perspective view of another embodiment of a self-adjusting bar clamp according to the present invention, shown in the open position.
Figure 6:
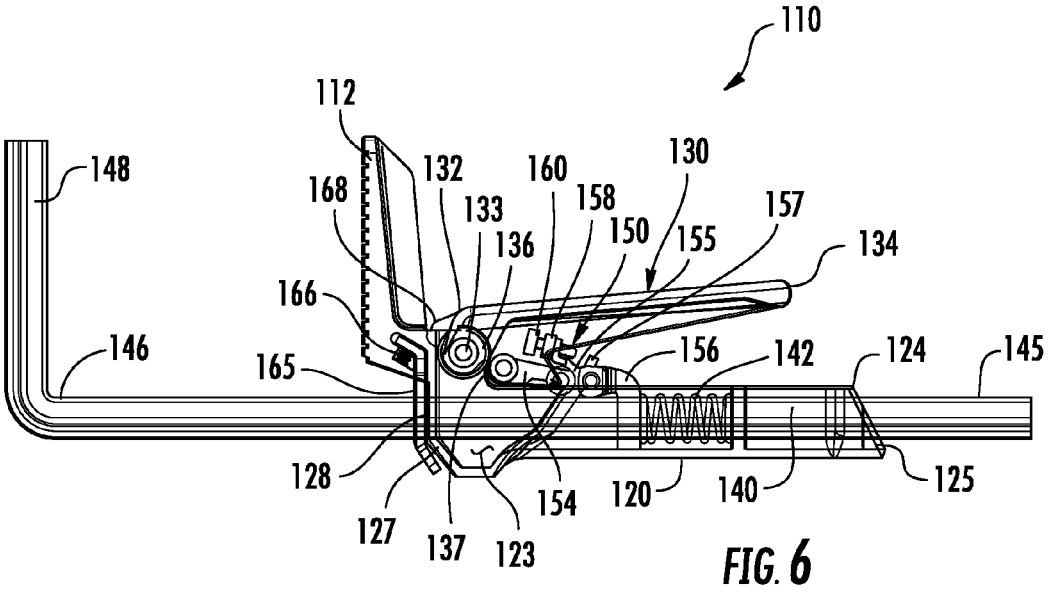
FIG. 6 is a sectional side view of the self-adjusting bar clamp of FIG. 5, in the closed position.
Figure 9:
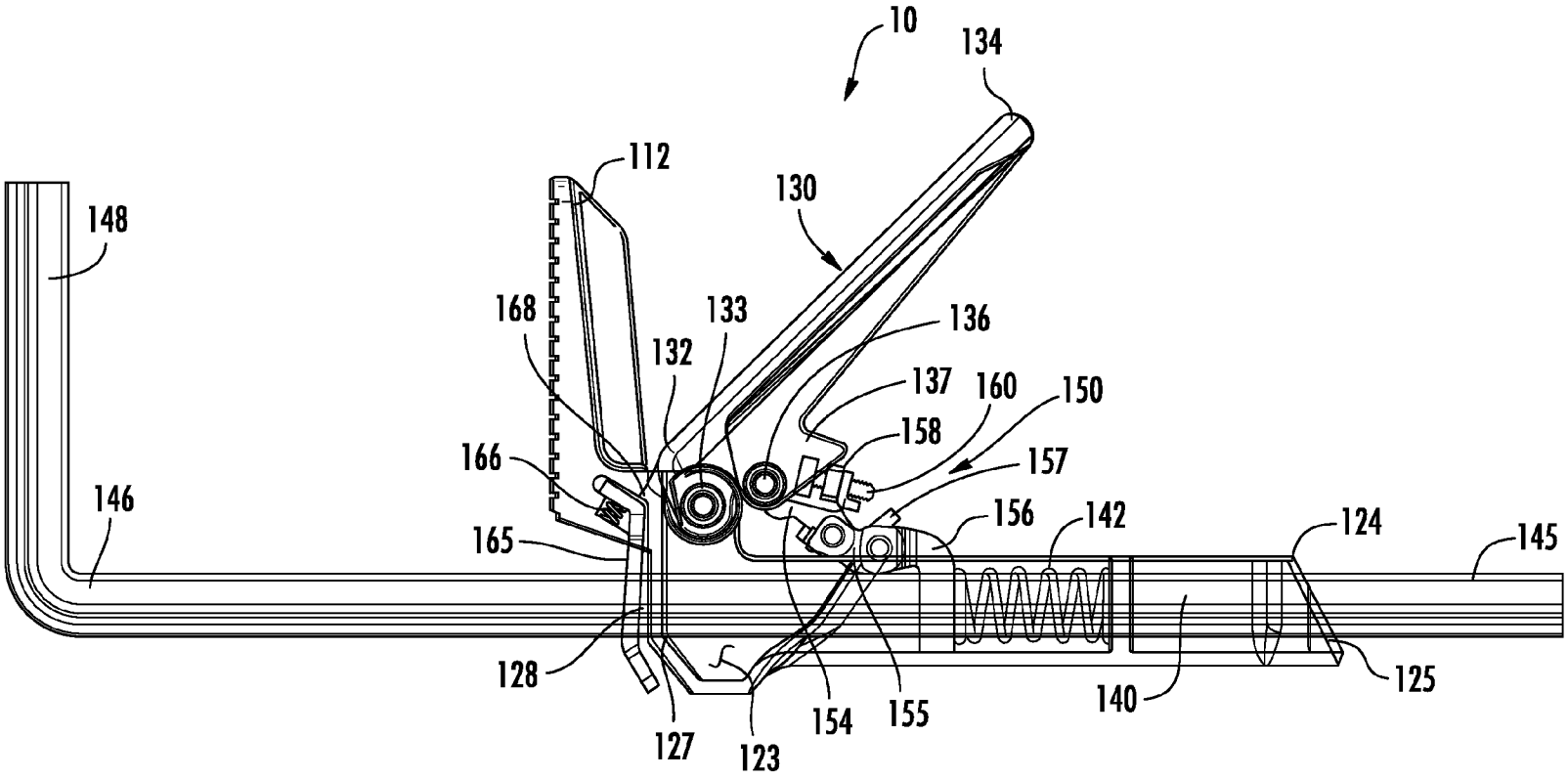
FIG. 9 is a sectional side view of the self-adjusting bar clamp of FIG. 5, in the open position.

Turning to FIGS. 5, 6 and 9, another embodiment of a self-adjusting bar clamp, designated 110, in accordance with the present invention is illustrated. Clamp 110 includes a body 120 formed of a pair of upright sides 122 extending in parallel spaced apart relationship to essentially form an elongated channel 123. Sides 122 are joined at a rear end 124 and define a rear aperture 125. Sides 122 are joined at a front end 127 and define a front aperture 128. Body 120 further includes a jaw member 112 extending substantially perpendicularly from front end 127. An elongated actuating lever 130 includes a forward end 132 pivotally coupled to body 120 at the junction between front end 127 and jaw member 112 above elongated channel 123 at a pivot point 133, and extends rearwardly to a rearward end 134. Actuating lever 130 includes, in this specific embodiment, a pivot point 136 extending between two parallel projections 137 extending downwardly from actuating lever 130 intermediate forward end 132 and rearward end 134. The two parallel projections 137 are spaced apart at pivot point 136 to form a mounting yoke that is positioned on both sides of a link, with a pivot pin extending through both parallel projections 137 and the link, which will be described presently.

Figure 10:
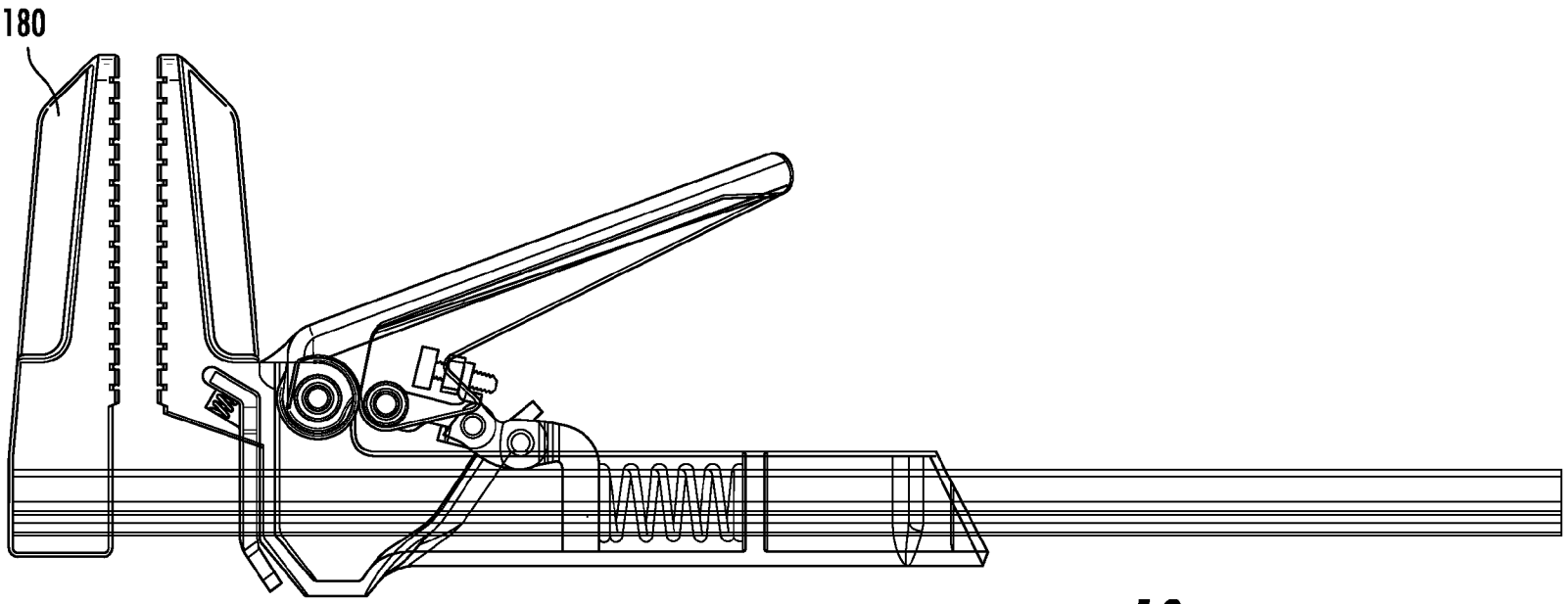
FIG. 10 is a sectional side view of the self-adjusting bar clamp of FIG. 5, with a jaw as the pressure foot.

Still referring to FIGS. 5, 6 and 9, an elongated bar 140 with a compression spring 142 axially disposed around a portion thereof, is positioned in elongated channel 123 of body 130. Bar 140 includes a rearward end 145 extending rearwardly from rear aperture 125 and a forward end 146 extending forwardly from front aperture 128 and terminating in a pressure foot 148, which in this embodiment is a portion of bar 140 extending perpendicularly from forward end 146. Alternatively, pressure foot 148 can be an upright member (jaw 180) attached to bar 140 (FIG. 10). Pressure foot 48 can also be provided with different shapes for different purposes, and interchangeably attached to forward end 146. Pressure foot 148 is spaced from and, in this embodiment, substantially parallel to jaw member 112. Bar 140 is carried by body 120 for reciprocal sliding movement therethrough.

A self-adjusting toggle mechanism 150 generally includes three pivotally linked elements designated element 154, cam element 155, and locking element 156. Element 154 has an elongated body with the forward end pivotally attached between spaced apart parallel projections 137 of actuating lever 130 at pivot point 136. The rearward end of element 154 is bifurcated and the forward end of cam element 155 is pivotally mounted in the bifurcation. Also, the rearward end of element 154 has a vertically upwardly extending boss 158 formed thereon with a horizontally extending (generally parallel to element 154) threaded opening therethrough. An adjustment screw 160 is threadedly engaged in the opening and is oriented so that the rearwardly extending end is movable. The rear end of cam element 155 is pivotally engaged in a bifurcated forward end of locking element 156 and the rear end of locking element 156 is slideably engaged over bar 140 and butts against a forward end of compression spring 142. The rearward end of spring 142 butts against the inner rear end 124 of body 120. Spring 142 is captured between rear end 124 and locking element 156. The rear end of cam element 155 defines an upwardly and forwardly facing pressure adjustment surface 157 positioned to engage the front end of adjustment screw 160 and adjust downward pivotal movement of self-adjusting toggle mechanism 150.

Figure 7:
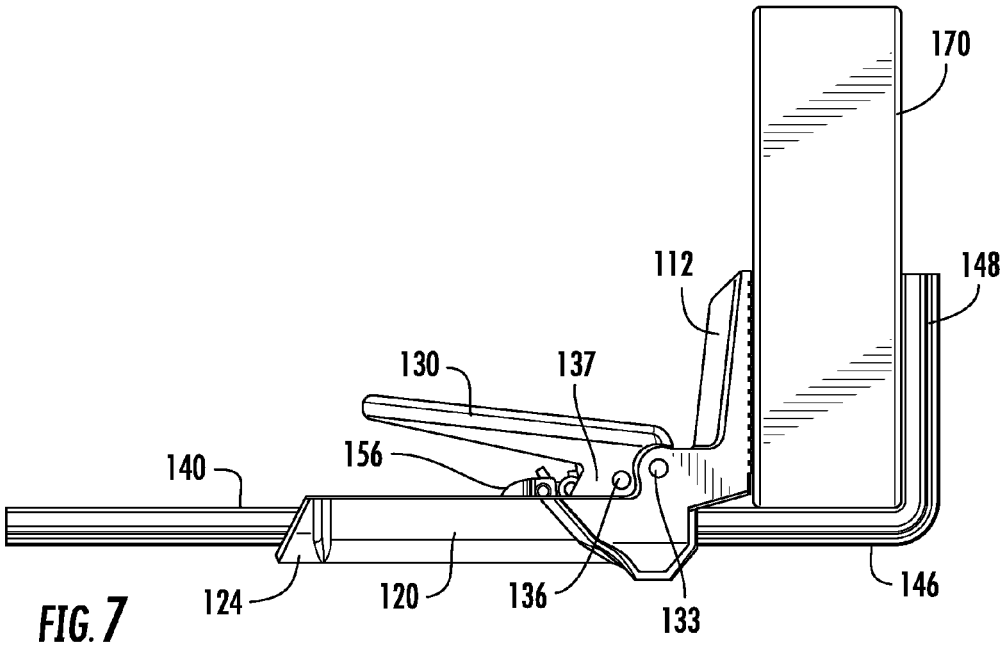
FIG. 7 is a side view of the self-adjusting bar clamp of FIG. 1, in the closed position.
Figure 8:
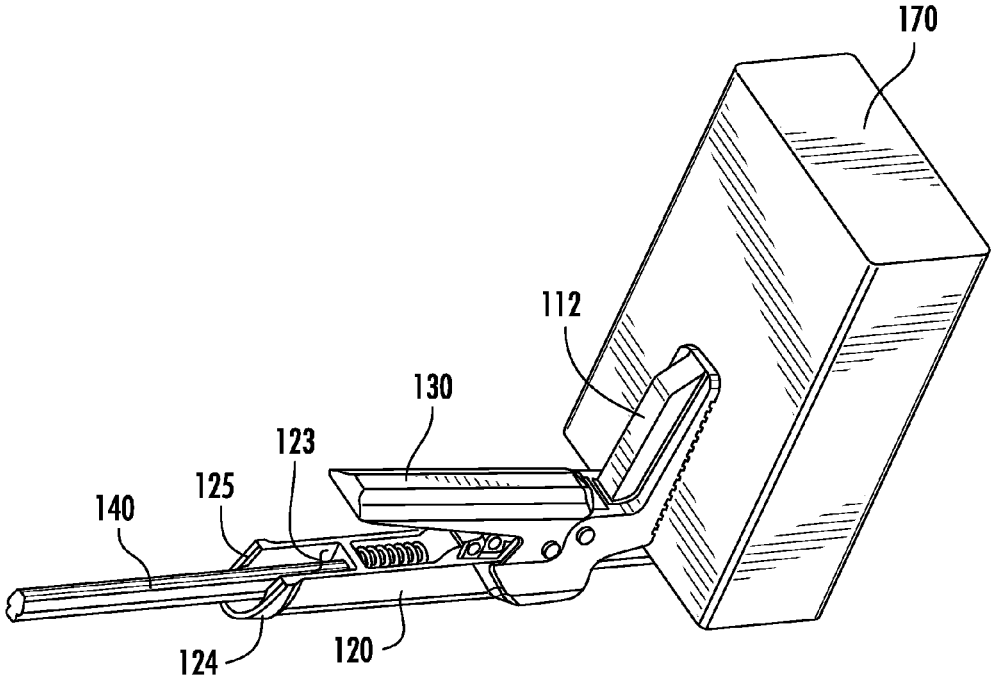
FIG. 8 is a perspective view of the self-adjusting bar clamp of FIG. 1, in the closed position.

With additional reference to FIGS. 7 and 8, actuating lever 130 is movable between an opened position (FIG. 5) and a closed position (FIGS. 7 and 8) to clamp a work piece 170 between jaw member 112 and pressure foot 148. In the opened position of actuating lever 130, pressure foot 148 is spaced from work piece 170 and locking element 156 is positioned for sliding movement in relation to bar 140. When actuating lever 130 is moved to the closed position, bar 140 is moved incrementally rearwardly, closing the distance between pressure foot 148 and jaw member 112. When actuating lever 130 is moved to the open position bar 140 is typically moved incrementally forwardly. However, to allow closing of the space by use of (pumping of) actuating lever 130, a secondary locking element 165 is carried by elongated bar 140 proximate forward end 127 of body 120, and movable between an engaged position and a released position. Secondary locking element 165 is biased by a spring 166 into frictional engagement with bar 140, preventing forward movement thereof while allowing rearward movement. In this manner, each time actuating lever 130 is moved between the open position and the closed position, bar 140 is moved incrementally rearwardly, and when actuating lever 130 is moved between the closed position and the open position, bar 140 is held in position, resulting in space between jaw member 112 and pressure foot 148 being reduced. Secondary locking element 165 can be released by moving the bottom of locking element 165 rearwardly, tilting it against the bias of spring 166 to the release position and releasing bar 140. A lobe 168 can also be formed on forward end 132 of actuating lever 130, extending forwardly. Lobe 168 engages the top of locking element 165 with actuating lever 130 in the fully open position, tilting locking element 165 against the bias of spring 166 to the release position and releasing bar 140. Either method can be employed as desired. The space between jaw member 112 and pressure foot 148 can then be increased by manually pushing bar 140 in a forward direction. The operation of self-adjusting toggle mechanism 150 is substantially the same as described with respect to self-adjusting toggle mechanism 50.

Figure 11:
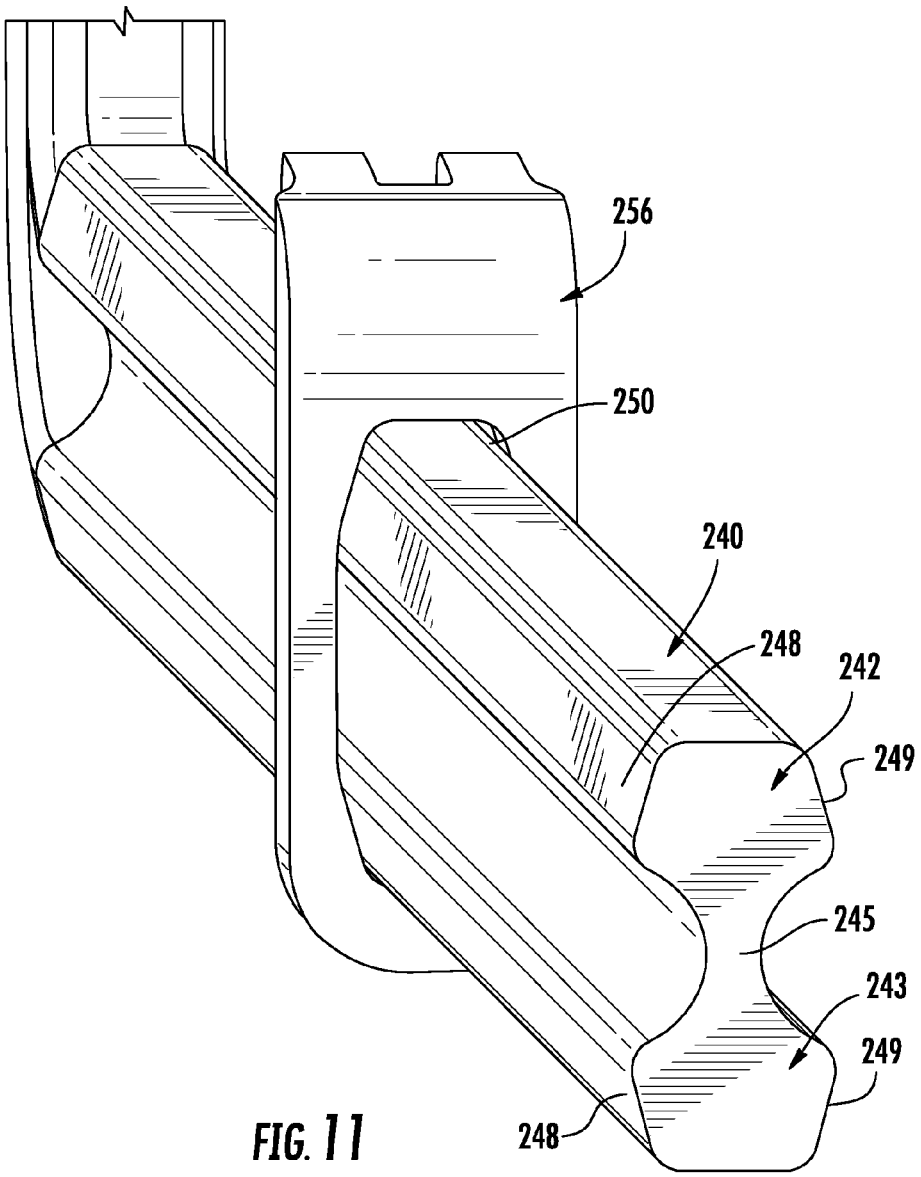
FIG. 11 is an enlarged perspective view of an elongated bar and associated locking element.

Turning now to FIG. 11, another embodiment of an elongated bar 240 and locking element 256 are illustrated. While conventional bars used in bar clamps employ bars having a top surface and a bottom surface with which a locking element frictionally engages, bar 240 in this embodiment has two parallel portions 242 and 243, joined by a longitudinal web 245. Each portion 242 and 243 has opposed surfaces 248 and 249, extending longitudinally the length of each portion. Locking element 256 has an aperture 250 through which bar 240 extends, the edges of which engage opposed surfaces 248 and 249 of each portion 242 and 243. Opposed surfaces 248 and 249, of each portion 242 and 243, are formed having a preferred 15 degree angle from vertical. While small variations in the angle will work, the 15 degree angle provides the optimal surface for frictional engagement. A greater angle can result in binding of locking element 256, preventing easy release, and a lesser angle can result in slippage, and an insecure engagement. By providing a bar with four engagement surfaces, a larger surface is engaged at one time, providing a stronger and more secure friction lock.

Figure 12:
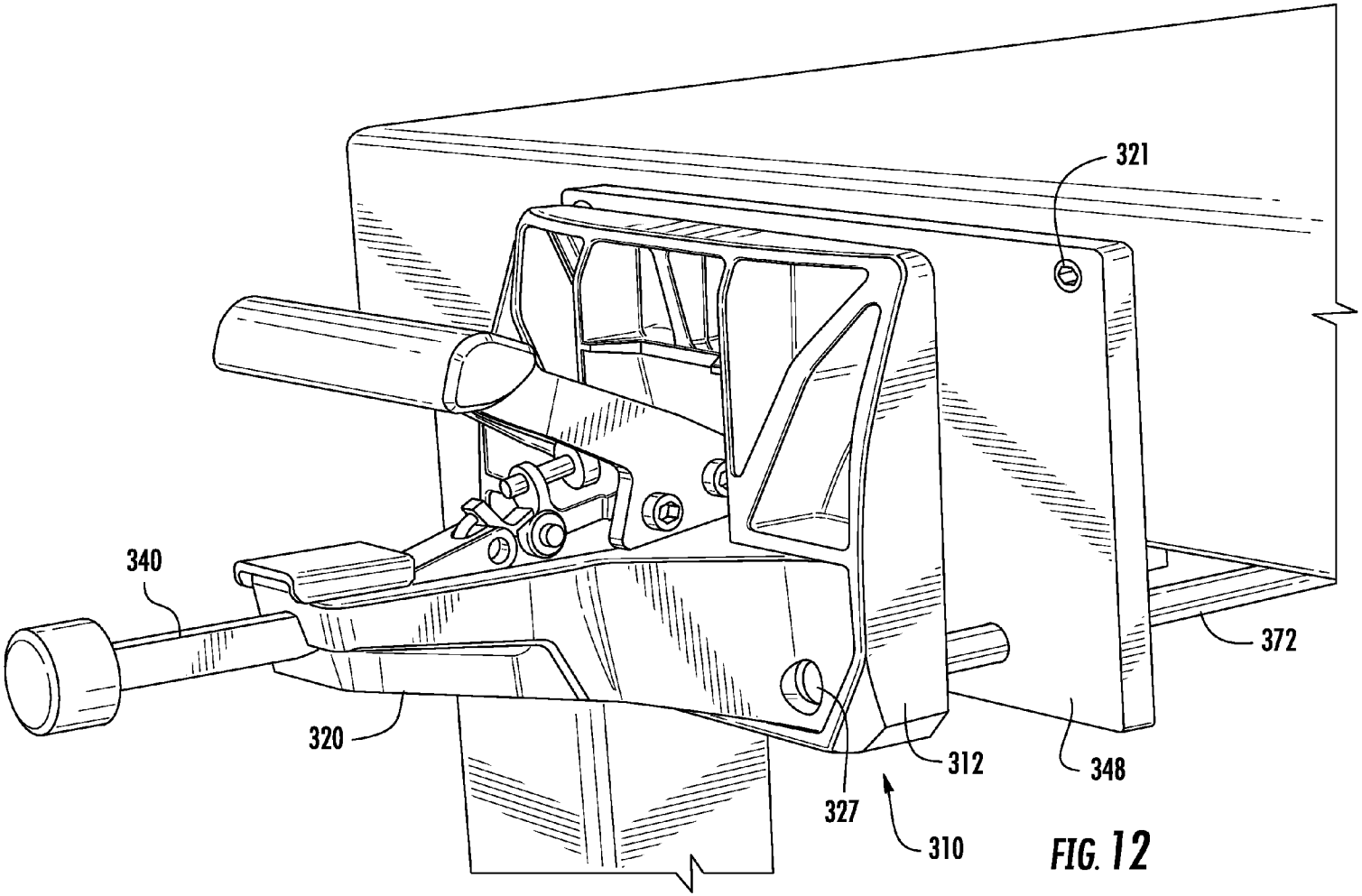
FIG. 12 is a perspective view of an embodiment of the self-adjusting bar clamp of the present invention affixed to the side of a bench for use as a vise.

Referring now to FIG. 12, another embodiment of a self-adjusting bar clamp, designated 310, is illustrated. Clamp 310 is essentially the same as bar clamp 110, with the addition of some elements to provide stability to the opposing jaws and a mounting apparatus. Clamp 310 includes a body 320 substantially identical to body 120, but wider to accommodate wider jaws. Clamp 310 includes a jaw member 312 extending substantially perpendicularly from a front end 327 of body 320. Jaw member 312 has been widened to provide a larger surface for clamping as is typical in vises. An elongated bar 340 is carried by body 320 for reciprocal sliding movement therethrough. Bar 340 terminates in a pressure foot 348 aligned with and widened to match jaw member 312. In this embodiment pressure foot 312 includes a mounting apparatus 321 for attaching clamp 310 to the side of a workbench to act as a vise. Pressure foot 312, bar 340 and jaw member 312 are stabilized with respect to one another by stabilizing rods 372 positioned on either side and parallel to bar 340. Stabilizing rods 372 extend from jaw member 312 and are slidably received through pressure foot 312. In this manner, clamp 310 can be mounted to a workbench to act as a vise.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A self-adjusting bar clamp comprising:

a body having a rear end defining a rear aperture and a front end defining a front aperture, the body defining an elongated channel extending between the rear end and the front end;

an actuating lever having a first end pivotally coupled to the body at a pivot point and movable between an open position and a closed position and a second end;

an elongated bar positioned in the elongated channel of the body, the elongated bar having a rearward end extending rearwardly from the rear aperture and a forward end extending forwardly from the front aperture and terminating in a pressure foot, the elongated bar carried by the body for reciprocal sliding movement therethrough;

a self-adjusting toggle mechanism including:

a locking element carried by the elongated bar within the elongated channel for reciprocal and canting movement;

an element pivotally coupled to the actuating lever intermediate the first end and the second end; and a cam element pivotally coupled to the element and pivotally coupled to the locking element, the cam element movable between a first condition permitting the locking element to reciprocate along the elongated bar and a second condition bearing against the elongated bar and canting the locking element into frictional engagement with the elongated bar; and a biasing member captured between one of the rear end and the front end of the body, and the locking element, biasing the locking element in a first direction.

2. A self-adjusting bar clamp as claimed in claim 1, further comprising an adjustment mechanism engaging the cam element for selectively modifying the movement of the cam element.

3. A self-adjusting bar clamp as claimed in claim 2, wherein the adjustment mechanism comprises:

a boss formed on the element and extending vertically upwardly with a horizontally extending threaded opening therethrough; and an adjustment screw threadedly engaged in the opening and oriented so that an extending end of the screw is movable; and an end of the cam element defining an upwardly facing pressure adjustment surface positioned to engage the extending end of the adjustment screw and adjust downward pivotal movement of the self-adjusting toggle mechanism.

4. A self-adjusting bar clamp as claimed in claim 1, wherein the elongated bar further comprising two parallel portions joined by a longitudinal web and opposed planar surfaces extending longitudinally the length of each portion to frictionally engage the locking element.

5. A self-adjusting bar clamp as claimed in claim 4, wherein opposed surfaces of each portion are formed having a preferred 15 degree angle from vertical.

6. A self-adjusting bar clamp as claimed in claim 1, further comprising a jaw member coupled to the front end of the body and aligned with the pressure foot.

7. A self-adjusting bar clamp as claimed in claim 1, further comprising:

the locking element in the opened position of the actuating lever being positioned for sliding movement in relation to the elongated bar, the locking member in the closed position of the actuating lever, moves the elongated bar incrementally through the body in a second direction opposite the first direction; and a secondary locking element carried by the elongated bar proximate the forward end of the body and movable between an engaged position and a released position, the secondary locking element biased by a second biasing member into frictional engagement with the elongated bar in the engaged position, preventing movement of the elongated bar in the first direction, and selectively movable to disengage the elongated bar in the release position against the bias of the second biasing member, permitting movement of the elongated bar in the first direction.

8. A self-adjusting bar clamp as claimed in claim 7 further comprising a lobe extending forwardly from the first end of the actuating lever, the lobe engaging the secondary locking element with the lever in the open position, moving the secondary locking element to the release position.

9. A self-adjusting bar clamp as claimed in claim 1 wherein the body further includes mounting apparatus.

10. A self-adjusting bar clamp comprising:

a body having a rear end defining a rear aperture and a front end defining a front aperture, the body defining an elongated channel extending between the rear end and the front end;

an actuating lever having a first end pivotally coupled to the body at a pivot point proximate the front end and movable between an open position and a closed position, and a second end extending rearwardly from the first end;

an elongated bar positioned in the elongated channel of the body, the elongated bar having a rearward end extending rearwardly from the rear aperture and a forward end extending forwardly from the front aperture and terminating in a pressure foot, the elongated bar carried by the body for reciprocal sliding movement therethrough;

a jaw member coupled to the front end of the body and aligned with the pressure foot;

a self-adjusting toggle mechanism including:

a locking element carried by the elongated bar within the elongated channel for reciprocal and canting movement;

an element pivotally coupled to the actuating lever intermediate the first end and the second end, forward of the locking element; and a cam element pivotally coupled to the element and pivotally coupled to the locking element, the cam element movable between a first condition permitting the locking element to reciprocate along the elongated bar and a second condition bearing against the elongated bar and canting the locking element into frictional engagement with the elongated bar, preventing reciprocating movement along the elongated bar;

a biasing member captured between the rear end of the body and the locking element, biasing the locking element in a forward direction;

wherein the locking member in the opened position of the actuating lever being positioned for sliding movement in relation to the elongated bar, the locking member in the closed position of the actuating lever, moves the elongated bar incrementally through the body in a rearward direction; and a secondary locking element carried by the elongated bar proximate the forward end of the body and movable between an engaged position and a released position, the secondary locking element biased by a second biasing member into frictional engagement with the elongated bar in the engaged position, preventing movement of the elongated bar in the forward direction, and selectively movable to disengage the elongated bar in the release position against the bias of the second biasing member, permitting movement of the elongated bar in the forward direction.

11. A self-adjusting bar clamp as claimed in claim 10, further comprising an adjustment mechanism engaging the cam element for selectively modifying the movement of the cam element.

12. A self-adjusting bar clamp as claimed in claim 11, wherein the adjustment mechanism comprises:

a boss formed on the element and extending vertically upwardly with a horizontally extending threaded opening therethrough; and an adjustment screw threadedly engaged in the opening and oriented so that an extending end of the screw is movable; and an end of the cam element defines an upwardly facing pressure adjustment surface positioned to engage the extending end of the adjustment screw and adjust downward pivotal movement of the self-adjusting toggle mechanism.

13. A self-adjusting bar clamp as claimed in claim 10 further comprising a lobe extending forwardly from the first end of the actuating lever, the lobe engaging the secondary locking element with the lever in the open position, moving the secondary locking element to the release position.

14. A self-adjusting bar clamp as claimed in claim 10, wherein the elongated bar further comprising two parallel portions joined by a longitudinal web and opposed planar surfaces extending longitudinally the length of each portion to frictionally engage the locking element.

15. A self-adjusting bar clamp as claimed in claim 14, wherein opposed surfaces of each portion are formed having a preferred 15 degree angle from vertical.

16. A self-adjusting bar clamp comprising:

a body having a rear end defining a rear aperture and a front end defining a front aperture, the body defining an elongated channel extending between the rear end and the front end;

an actuating lever having a first end pivotally coupled to the body at a pivot point proximate the rear end and movable between an open position and a closed position, and a second end extending forwardly from the first end;

an elongated bar positioned in the elongated channel of the body, the elongated bar having a rearward end extending rearwardly from the rear aperture and a forward end extending forwardly from the front aperture and terminating in a pressure foot, the elongated bar carried by the body for reciprocal sliding movement therethrough;

a self-adjusting toggle mechanism including:

a locking element carried by the elongated bar within the elongated channel for reciprocal and canting movement;

an element pivotally coupled to the actuating lever intermediate the first end and the second end, rearward of the locking element; and a cam element pivotally coupled to the element and pivotally coupled to the locking element, the cam element movable between a first condition permitting the locking element to reciprocate along the elongated bar and a second condition bearing against the elongated bar and canting the locking element into frictional engagement with the elongated bar; and a biasing member captured between the front end of the body, and the locking element, biasing the locking element in a rearward direction.

17. A self-adjusting bar clamp as claimed in claim 16 wherein the body further includes mounting apparatus.

18. A self-adjusting bar clamp as claimed in claim 17, wherein the elongated bar further comprising two parallel portions joined by a longitudinal web and opposed planar surfaces extending longitudinally the length of each portion to frictionally engage the locking element.

19. A self-adjusting bar clamp as claimed in claim 18, wherein opposed surfaces of each portion are formed having a preferred 15 degree angle from vertical.

* * * * *